US005590885A

United States Patent [19]

Graham et al.

[11] Patent Number: 5,590,885

[45] Date of Patent: Jan. 7, 1997

[54] SAFETY DART BOARD GAME

[76] Inventors: Garnard E. Graham; Mary E. Graham, both of P.O. Box 2318, Battle Ground, Wash. 98604-2318

[21] Appl. No.: 565,644

[22] Filed: Nov. 29, 1995

[51] Int. Cl.[6] ..... F41J 3/00

[52] U.S. Cl. ..... 273/348.5; 273/338; 473/574

[58] Field of Search ..... 273/347, 343, 273/338

[56] References Cited

U.S. PATENT DOCUMENTS

| | | | |
|---|---|---|---|
| 3,124,119 | 3/1964 | Ayala | 124/12 |
| 3,735,748 | 5/1973 | Gaylord | 124/12 |
| 3,894,736 | 7/1975 | Foley | 273/95 R |
| 3,997,162 | 12/1976 | Scullin | 273/95 R |
| 4,419,978 | 12/1983 | Loftus | 124/62 |
| 4,537,176 | 8/1985 | Stravitz et al. | 124/62 |

FOREIGN PATENT DOCUMENTS

| | | | |
|---|---|---|---|
| 775002 | 1/1968 | Canada | 273/347 |
| 2044391 | 3/1972 | Germany | 273/347 |
| 693201 | 1/1965 | Italy | 273/347 |

OTHER PUBLICATIONS

Magnum Air Darts, product price list, Rockaway, Oregon, circa 1995.

*Primary Examiner*—Mark S. Graham
*Attorney, Agent, or Firm*—Dellett and Walters

[57] ABSTRACT

A safety dart game comprising a dart including an open leading end portion having a side wall that defines an interior cavity and a target including a base and a plurality of spaced, finger-like projections extending generally outwardly from the base, the projections having a diameter sized to frictionally engage the interior cavity of the dart when the dart is projected onto the target. The projections on the target may be arranged such that a plurality of the projections frictionally engage an external surface of the dart when the dart is projected onto the target.

8 Claims, 2 Drawing Sheets

SAFETY DART BOARD GAME

This invention relates to a safety dart board game, and more particularly to a safety dart board game having improved safety darts.

BACKGROUND OF THE INVENTION

Blow dart guns have been in use for centuries and were developed before the discovery of gunpowder. Blow guns initially used by natives consisted of a hollow reed with a dart having a sharp point for piercing objects. In recent years, darts and dart boards have evolved into a game, especially for use by children. However, the typical dart still retains its sharp point and results in injuries to the players and damage to household furniture and walls.

An object of the present invention is, therefore, to provide a dart target game having a safety dart that does not contain a sharp point.

Another object of the present invention is to provide a safety dart having an interior cavity for frictionally encircling a projection on a target.

A further object of the present invention is to provide a target having elongate projections wherein a plurality of the projections frictionally engage an exterior surface of the safety dart.

Still another object of the present invention is to provide a safety dart manufactured as a unitary article for ease of manufacturing.

SUMMARY OF THE INVENTION

The present invention relates to a safety dart board target and a safety dart wherein the dart and the board cooperate so that no sharp points are utilized on the dart. The dart is manufactured so that it will fit onto a projection on the board or be held between the projections on the board, each time the dart is projected. The board comprises a base having projections of a predetermined length, the projections each having a diameter sized such that an interior cavity of the dart frictionally encircles a projection on a target upon impact. Additionally, the projections are spaced apart to form a bounded area having a diameter that is slightly smaller than the maximum diameter of the leading end of the safety dart so that the dart will frictionally engage the projections upon impact with the target. Some resiliency in either the projections or the safety dart is provided so that there will be some yielding of the resilient member to provide a frictional force to hold the safety dart on the target. As shown, the projections on the target can be molded from plastic material as a unit with the base.

The darts themselves are made to simulate conventional darts as to balance, size, and throwing characteristics. The darts may have a tapered open leading end to guide the dart so that it encircles a projection or fits between a plurality of projections on the board. The open leading end also prevents damage to walls, floors or furniture, and prevents injury to people and animals.

The board can be made in a variety of animal shapes and colors. Additionally, elastic or rubber bands can be placed around the base of the projections in any desired configuration to form a target outline such as a bulls-eye, or different scoring areas on the target board.

The darts are long lasting because they are preferably manufactured as a unitary piece using durable, resilient plastic. Additionally, the board is not punctured by sharp pointed darts, used conventionally, and thus the life of the board is greatly increased without deterioration in holding power or appearance.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
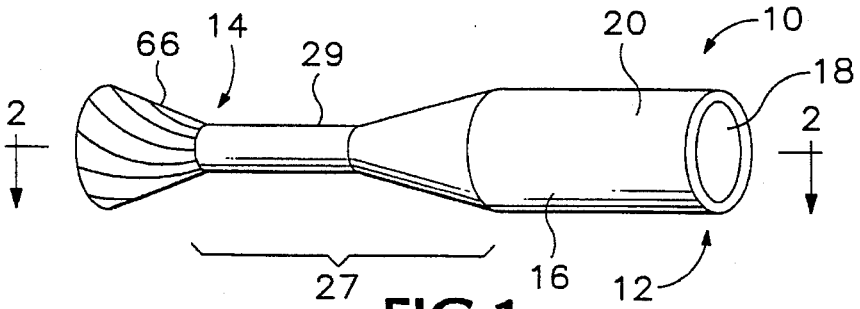
FIG. 1 is a perspective view of the safety dart of the present invention.

FIG. 1 shows a safety dart, illustrated generally as 10. The dart is an elongate member having a leading end portion 12 and a tail end portion 14. Leading end portion 12 includes a side wall 16 that defines an interior cavity 18 and an external surface 20.

Figure 2:
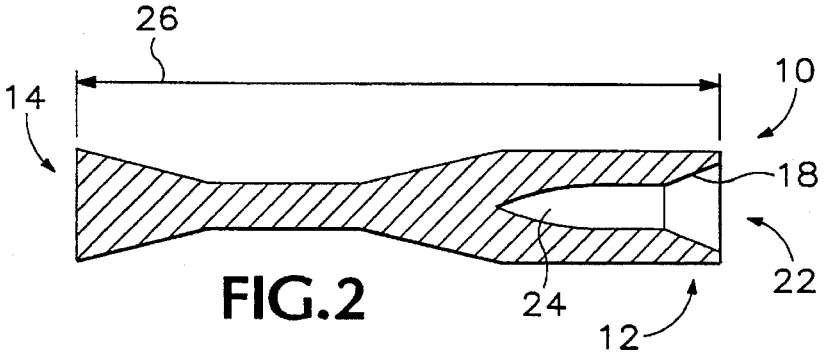
FIG. 2 is a cross sectional view taken along line 2—2 of FIG. 1.

As shown in FIG. 2, interior cavity 18 has an open end 22 and a tapered end portion 24 positioned opposite the open end.

Safety dart 10 is preferably manufactured as a unitary piece of a resilient material such as plastic. Dart 10 is preferably 4.5 centimeters (cm) measured along its length 26 and has a diameter of 0.8 cm measured across leading end 12 and along the widest portion of tail end 14. Tapered region 27 preferably has a length of 2.5 cm and a diameter at its narrowest region 29 of 0.4 cm. Leading end 12 preferably has a length of 1.3 cm and tail end 14 preferably has a length of 0.7 cm. Cavity 18 preferably has a diameter of 0.5 cm and a depth of 1.5 cm measured parallel to length 26.

Figure 3:
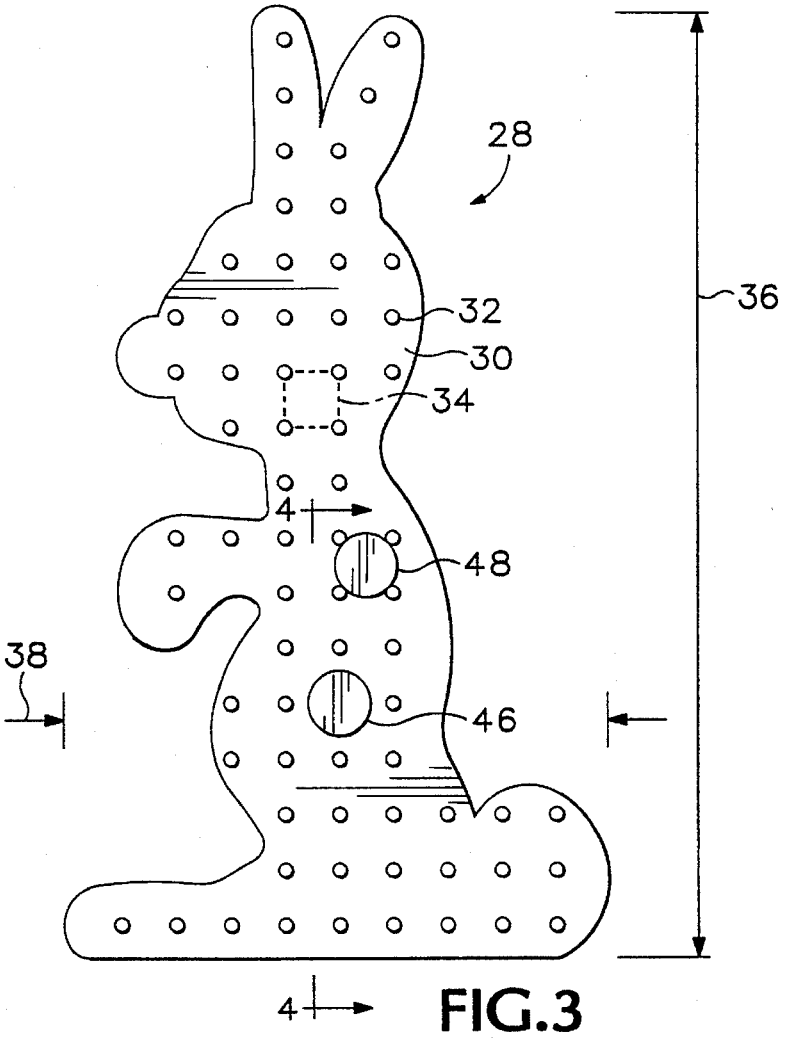
FIG. 3 is a front elevational view of a safety dart board of the present invention.

FIG. 3 shows a typical target 28 manufactured in the shape of a rabbit. Those skilled in the art will realize that target 28 can be manufactured in a variety of colors and in a variety of shapes such as a rabbit, a dinosaur, a bear, a duck or a typical bulls-eye type shape. Target 28 comprises a base 30 and a plurality of spaced, finger-like projections 32 extending generally perpendicularly outwardly from the base. Projections 32 are positioned in a substantially uniform pattern such that a subset of the plurality of projections defines a bounded area 34 shown by dot-dash lines. In the preferred embodiment, shown in FIG. 3, bounded area 34 is the shape of a square and is defined by four projections. In another embodiment, shown in FIG. 5, bounded area 34 is the shape of a triangle and is bounded by three projections.

Figure 4:
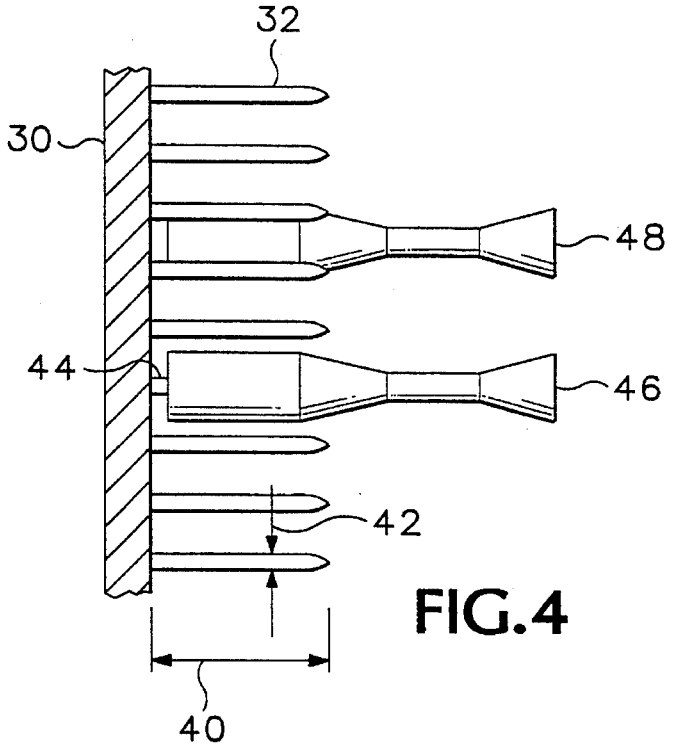
FIG. 4 is a side sectional view taken along line 4—4 of FIG. 3.
Figure 5:
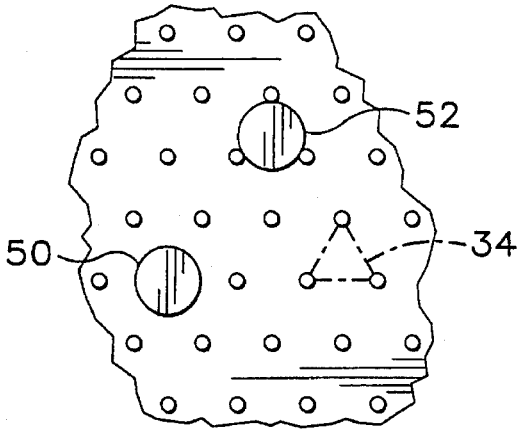
FIG. 5 is a partial front elevational view of a second embodiment of a safety dart board.

In the preferred embodiment, target 28 is approximately 11 cm long as measured along height 36 and is approximately 6 cm wide measured along width 38. The length 40 of projections 32, shown in FIG. 4, is preferably 2 cm and the diameter 42 of projections 32 is preferably 0.3 cm. The projections and the base are preferably manufactured as an integral unit from a resilient material, such as plastic. Projections 32 preferably have a tapered end and are sized to frictionally engage the interior cavity of the dart when the dart is projected onto the target. The projections are also sized and spaced in relation to each other so as to frictionally engage the external surface of the dart positioned within the bounded area when the dart is projected onto the target. For example, as shown in FIGS. 3 and 4, a dart 44 is positioned on the target such that projection 44 frictionally engages the cavity of dart 46. The external surface of dart 48 is frictionally engaged by four projections thereby securing the dart to the base. As shown in FIG. 5, the cavity of dart 50 is secured on a projection, and the external surface of dart 52 is frictionally engaged by three projections.

Figure 6:
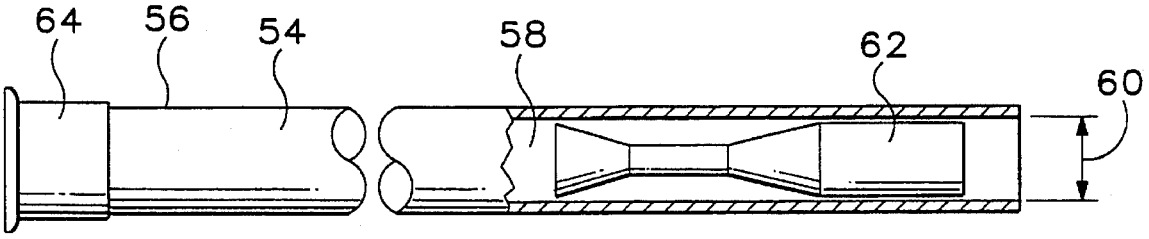
FIG. 6 is a side elevational view of a safety dart and a safety dart blow gun, the blow gun partially broken away along its length to show the dart in position within the blow gun.

As shown in FIG. 6, the darts are projected onto the target by use of a blow gun 54. Blow gun 54 comprises an elongate tubular member 56 having a hollow interior 58 that is open at both ends. Hollow interior 58 has a diameter 60 of approximately 1.0 cm such that a dart 62 fits within the interior for projection from the blow gun. In other embodiments, blow gun 54 may be shaped as pistol, a cross bow, or a sling shot. In yet another embodiment, feathers may be attached to tail end 14 such that a person may throw the dart instead of using a blow gun.

In operation, a dart is positioned inside the hollow interior of the blow gun and air pressure is applied at mouthpiece 64. The air pressure forces the dart from the mouthpiece outwardly from the blow gun and onto the target. Upon impact with the target, the dart will be forced onto a projection or into a bounded area between several projections. The tapered ends of the projections facilitate positioning of the dart either around a projection such that a projection frictionally engages the interior cavity of the dart, or between several projections such that the projections frictionally engage the external surface of the dart.

During flight of the dart from blow gun 54 toward a target, open cavity 18 creates an air turbulence at leading end 12 of the dart. To facilitate a smooth projection of the dart through the air, tail end 14 comprises curved channels 66 that facilitate spinning of the dart during projection. The spinning action decreases the effects of the turbulence at leading end 12 and increases the smoothness of the dart's flight.

While a preferred embodiment of the present safety dart apparatus has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A safety dart game apparatus comprising:

a dart including an open leading end portion having a side wall that defines an interior cavity wherein the interior cavity has an open end at the leading end portion of the dart and a tapered end portion opposite the open end; and a target including a base and a plurality of spaced, finger-like projections extending generally outwardly from the base, the projections having a diameter sized to frictionally engage the interior cavity of the dart when the dart is projected onto the target, wherein the projections have tapered ends positioned opposite the base, the tapered ends sized to frictionally engage the tapered end portion of the interior cavity of the dart.

2. A safety dart game apparatus according to claim 1 wherein the side wall defines an external surface sized to simultaneously frictionally engage a subset of the plurality of projections on the target.

3. A safety dart game apparatus according to claim 1 wherein the side wall of the dart defines an external surface, and wherein the projections are positioned in a substantially uniform pattern such that a subset of the plurality of projections defines a bounded area sized to frictionally engage the external surface of the dart when the dart is projected onto the target.

4. A safety dart game apparatus according to claim 3 wherein the subset comprises three projections such that the bounded area is triangularly shaped.

5. A safety dart game apparatus according to claim 3 wherein the subset comprises four projections such that the bounded area is square shaped.

6. A safety dart game apparatus according to claim 1 further comprising an elongate tubular member having a hollow interior that is open at an end, the hollow interior sized to receive the dart for projection from the elongate tubular member.

7. A safety dart game apparatus according to claim 1 wherein the target is manufactured of resilient plastic.

8. A safety dart game apparatus according to claim 1 wherein the dart is manufactured of resilient plastic.

* * * * *